United States Patent [19]

Gleason

[11] 4,225,107

[45] Sep. 30, 1980

[54] MUSIC HOLDER FOR DRUM

[76] Inventor: Kenneth R. Gleason, 316 E. Lake St., Rockwell City, Iowa 50579

[21] Appl. No.: 795,077

[22] Filed: May 9, 1977

[51] Int. Cl.[3] ..... G10G 5/00

[52] U.S. Cl. ..... 248/443; 84/411 R

[58] Field of Search ..... 248/443, 505, 507, 508, 248/441 B, 441 C, 225.3 R; 40/125 H; 84/411 R, 421, 472, 453

[56] References Cited

U.S. PATENT DOCUMENTS

| | | | |
|---|---|---|---|
| 2,167,564 | 7/1939 | Fonda | 40/125 H |
| 2,304,311 | 12/1942 | Luce | 248/503 |
| 2,524,518 | 10/1950 | D'Arcy | 84/411 |
| 3,227,414 | 1/1966 | Dean | 248/443 |

FOREIGN PATENT DOCUMENTS

| | | | |
|---|---|---|---|
| 172964 | 2/1935 | Switzerland | 84/472 |
| 399321 | 10/1933 | United Kingdom | 248/441 C |
| 718958 | 11/1954 | United Kingdom | 85/51 |

OTHER PUBLICATIONS

Elton Musical Products Catalog, 1963, p. 54.

*Primary Examiner*—Lawrence J. Staab
*Attorney, Agent, or Firm*—Henderon & Sturm

[57] ABSTRACT

The present invention relates to a music holder and more particularly to a music holder for use with a drum; the music holder having a slot and recessed area for receiving a drum tension rod as a method of securing the music holder to the drum.

1 Claim, 6 Drawing Figures

MUSIC HOLDER FOR DRUM

SUMMARY OF THE INVENTION

It is the object of this invention to provide a music holder for a drum that can be easily attached and detached to an from a drum by loosening or tightening a tension rod that is already an integral part of a snare drum, parade drum, marching drum, tym-toms, bongoes, timbales, or any other drum that has tension rods.

It is another object of this invention that when the music holder is attached to the drum that the music holder becomes an integral part of the drum.

It is another object of this invention to provide a music holder for a drum that can be permanently attached to the outer periphery of the surface of the drum and not obstruct the playing of the drum.

It is another object of this invention to provide a music holder that can be attached to the drum without any changes to the existing drum.

It is another object of this invention to provide a music holder that can be attached so simply and easily that a drum may be readied for playing in a matter of seconds only.

It is another object of this invention to provide a music holder that can be detached so simple and easily that a drum can be readied in a matter of seconds for storage, put in a case, or prepared for transportation.

It is another object of this invention to provide a music holder that provides a secure and rigid supporting frame for the attachment of conventional hinge rings that will hingedly support a plurality of open-ended, transparent envelopes that will hold the music for a performer.

The simplicity and ease of attaching and detaching the music holder will be readily apparent from the following description when considered in connection with the accompanying drawings of the present invention.

DETAILED DESCRIPTION OF THE DRAWINGS

Figure 1:
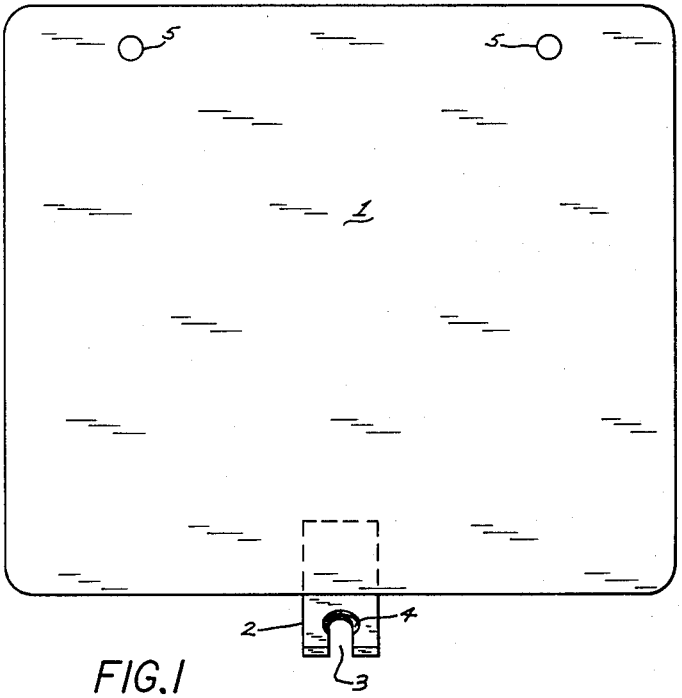
FIG. 1 is a front view of the music holder of the present invention.
Figure 2:
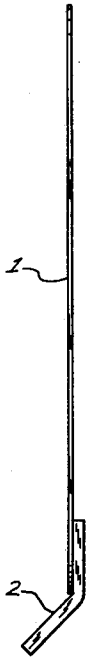
FIG. 2 is a side view of the music holder of the present invention.
Figure 3:
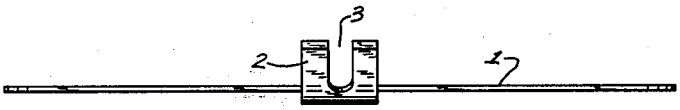
FIG. 3 is a bottom view of the music holder of the present invention.

Referring to the drawings numeral 1 designates the music supporting frame shown in a front view in FIG. 1, a side view in FIG. 2, and a bottom view in FIG. 3.

Numeral 2 designates the supporting and attaching arm in a front view in FIG. 1; a side view in FIG. 2, and a bottom view in FIG. 3.

Figure 5:
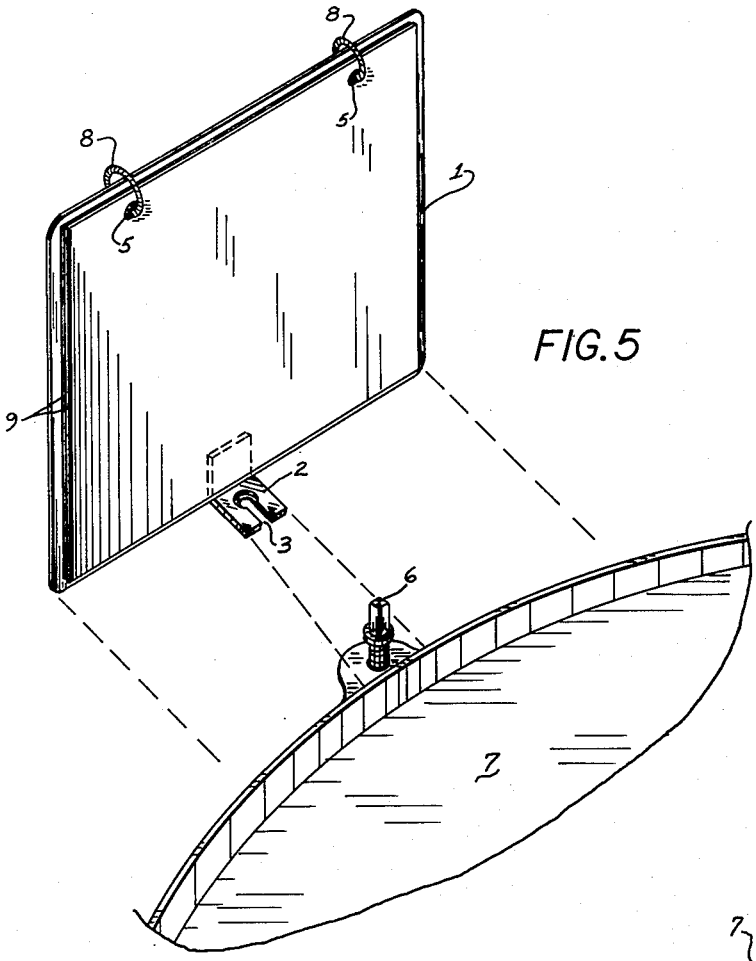
FIG. 5 is a view of the music holder of the present invention and the tension rod as it is located on the drum with hinged rings and opened-ended, transparent envelopes.

The method of attaching the music holder to a drum is shown in FIG. 5 when a tension rod 6 is unscrewed part way on drum 7. This allow for the attaching of the music holder frame 1 by the use of support arm 2.

Figure 4:
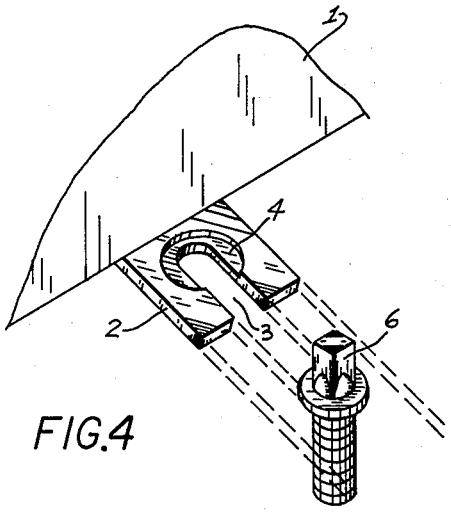
FIG. 4 is a view of a tension rod and the supporting arm of the music holder of the present invention.
Figure 6:
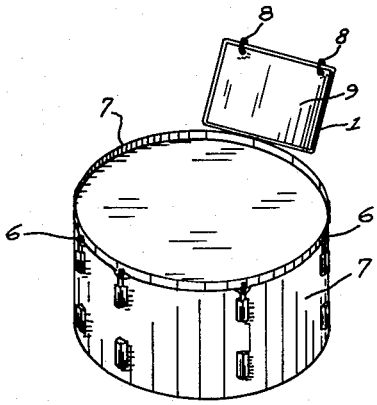
FIG. 6 is a view of the music holder of the present invention attached to a drum.

In FIG. 4 a detail of the construction of the support arm 2 is shown. Slot 3 is pushed around tension rod 6, so that the recessed area 4 will receive the round head of the tension rod 6 when it is screwed firmly onto drum 7 in FIG. 6; which makes the music holder an integral part of the drum.

In FIG. 1 the holse 5 will receive the hinged rings 8 as shown in FIG. 5. The open-ended, transparent envelopes 9 may be attached to the hinged rings 8 in any amount needed. The open-ended, transparent envelopes 9 are for the carrying of the music for the performer.

What is claimed is:

1. A music holder for a drum including a tension rod having a threaded shaft and an enlarged head, said music holder comprising:

a sheet music supporting frame, and an angled, one-piece support arm of sheet material attached to one end thereof to said frame, said support arm having an elongated slot formed in the other end of said support arm for receiving the shaft of said tnesion rod, and a recessed area formed in the upper surface of said support arm around the inner end of said slot for receiving the enlarged head of said tension rod as said tension rod is tightened, thereby firmly securing said music holder upon said drum.

* * * * *